US012102937B2

(12) United States Patent
Turchyn et al.

(10) Patent No.: US 12,102,937 B2
(45) Date of Patent: Oct. 1, 2024

(54) PEDAL OPERATED HURDLE

(71) Applicant: Litania Sports Group, Inc., Champaign, IL (US)

(72) Inventors: James L. Turchyn, Urbana, IL (US); Christopher E. Bray, Champaign, IL (US); C. David Hodge, Mahomet, IL (US); Gregory W. Luebbering, Heyworth, IL (US)

(73) Assignee: Litania Sports Group, Inc., Champaign, IL (US)

( * ) Notice: Subject to any disclaimer, the term of this patent is extended or adjusted under 35 U.S.C. 154(b) by 250 days.

(21) Appl. No.: 17/844,420

(22) Filed: Jun. 20, 2022

(65) Prior Publication Data

US 2023/0405486 A1 Dec. 21, 2023

(51) Int. Cl.
*A63K 3/04* (2006.01)

(52) U.S. Cl.
CPC ..... *A63K 3/043* (2013.01)

(58) Field of Classification Search
CPC ..... A63K 3/04; A63K 3/043; A63K 3/046; A63B 2022/051; A63B 61/04; A63B 2225/09; A63B 2225/093
See application file for complete search history.

(56) References Cited

U.S. PATENT DOCUMENTS

| | | | | |
|---|---|---|---|---|
| 7,438,668 | B1 | 10/2008 | Watry et al. | |
| 9,427,677 | B1 | 8/2016 | Bray et al. | |
| 9,486,714 | B1 * | 11/2016 | Carrel | A63K 3/043 |
| 2013/0053219 | A1 * | 2/2013 | Lindstrom | A63K 3/043 482/17 |
| 2016/0045839 | A1 * | 2/2016 | Holland | A63K 3/043 482/17 |
| 2018/0169454 | A1 * | 6/2018 | Bowman | A63K 3/043 |
| 2020/0122051 | A1 * | 4/2020 | Covalschi | A63B 69/0028 |

* cited by examiner

*Primary Examiner* — Megan Anderson
*Assistant Examiner* — Jonathan A Dicuia
(74) *Attorney, Agent, or Firm* — Philip L. Bateman

(57) ABSTRACT

A hurdle with a riser assembly having a gate board attached to movable gate tubes that telescope upon uprights and with a cross support between the trailing ends of the legs has a height adjustment system that includes a pedal in the cross support. Depressing the pedal retracts spring loaded posts to allow a user to hold and move the gate board up or down with the hands.

2 Claims, 6 Drawing Sheets

PEDAL OPERATED HURDLE

FIELD OF THE INVENTION

This invention relates to exercise devices. More particularly, this invention relates to track and field equipment. Still more particularly, this invention relates to hurdles.

BACKGROUND OF THE INVENTION

Track and field is a sport in which athletes compete in running, jumping, and throwing events. The hurdles are two events that combine running and jumping. In the hurdles, the athletes run in designated lanes and jump over spaced apart hurdles in between the start and finish. A hurdle consists of a base having two legs, two uprights, and a horizontal gate board (sometimes spelled "gateboard"). In the first hurdle event (commonly known as the high hurdles), athletes run about 100 meters and jump over relatively high hurdles. Unless otherwise indicated expressly or by context, the term "about" is used herein to mean plus or minus 25 percent of the measurement or other quantified property referenced. In the second hurdle event (commonly known as the low or intermediate hurdles), athletes run about 400 meters and jump over lower hurdles. The height of the hurdle in each of the events varies depending upon the age and sex of the athletes. For versatility and economy, most hurdles are adjustable in height.

Hurdles that are adjustable in height contain movable gate tubes (also known as risers) with an attached gate board to form a riser assembly that telescope relative to uprights. In most adjustable height hurdles, the gate tubes contain openings corresponding to the different heights and spring-loaded posts that extend through the chosen opening. A variety of actuators on the gate tubes are used to disengage the spring-loaded posts so the riser assembly can be moved up or down. In some hurdles, the posts are disengaged by depressing them directly. In the hurdle disclosed in Watry et al., U.S. Pat. No. 7,438,668, Oct. 21, 2008, the posts are disengaged by depressing buttons that are connected to the posts. In the hurdle disclosed in Bray et al., U.S. Pat. No. 9,427,677, Aug. 30, 2016, the posts are disengaged by squeezing on triggers. The Watry et al. patent and the Bray et al. patent are incorporated by reference.

A hurdle is designed to tip over if the athlete contacts it. The force at the gate board required to tip the hurdle over is commonly known as its tip-over weight (sometimes known as the pullover weight). The tip-over weight is a function of the height of the hurdle. Other things being equal, the tip-over weight decreases as the height of the hurdle increases. Most hurdles contain counterweights in the base to achieve the desired tip-over weight. To maintain a relatively constant tip-over weight as the height of the hurdle changes, many modern hurdles incorporate counterweights that move in the legs of the base. As the height of the hurdle increases, the counterweights are moved further away from the uprights and, as the height of the hurdle decreases, the counterweights are moved closer toward the uprights. In some hurdles, the counterweights are moved manually. In other hurdles, the counterweights are connected mechanically to the riser assembly so that they move automatically as the riser assembly is moved. Hurdles with automatically movable counterweights connected to the riser assembly are disclosed in Watry et al., U.S. Pat. No. 7,438,668, Oct. 21, 2008, and Carrel et al., U.S. Pat. No. 9,486,714, Nov. 8, 2015, each of which is incorporated by reference.

One problem associated with adjusting the height of conventional hurdles is that releasing the spring-loaded posts by moving the actuators on the gate tubes with the hands while simultaneously pulling up or pushing down on the riser assembly is difficult. Accordingly, a demand exists for an improved hurdle that eliminates hand-operated actuators on the gate tubes for adjusting the height of the gate board.

SUMMARY OF THE INVENTION

The general object of this invention is to provide an improved hurdle. A more particular object is to provide a hurdle that eliminates hand-operated actuators on the gate tubes for adjusting the height of the gate board.

We have invented an improved hurdle. The hurdle comprises: (a) two substantially parallel horizontal hollow legs, each leg having a leading end and a trailing end; (b) a horizontal hollow cross support connecting the trailing ends of the legs; (c) two stationary hollow uprights, each upright extending upwardly from the trailing end of a leg; (d) two movable hollow gate tubes, each gate tube telescoping relative to an upright and having a top end; (e) a gate board connecting the top ends of the gate tubes; (f) a counterweight system for maintaining tip-over weight, the counterweight system comprising a counterweight inside each leg, each counterweight being movable horizontally; and (g) a height adjustment system for adjusting the gate board to a plurality of heights, the height adjustment system comprising a pedal on the cross support.

The hurdle of this invention eliminates hand-operated actuators on the gate tubes for adjusting the height of the gate board. Instead, the hurdle of this invention has a foot-operated pedal on the cross support for releasing the spring-loaded posts. The foot pedal allows the user to place one or both hands on the gate board itself to move it up or down.

DETAILED DESCRIPTION OF THE INVENTION

1. The Invention in General

Figure 1:
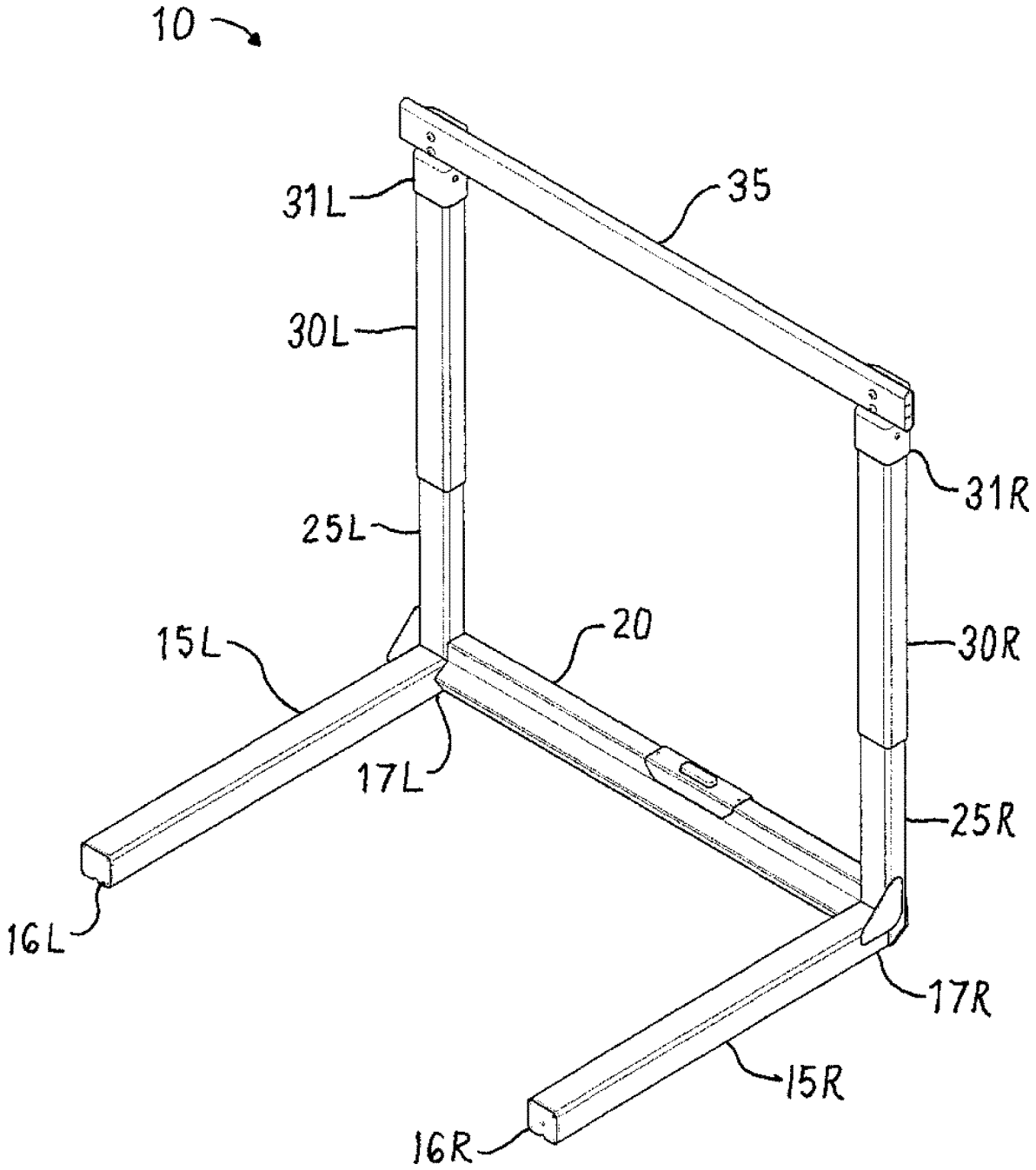
FIG. 1 is a front and right side perspective view of the exterior of a preferred embodiment of the hurdle of this invention.

This invention is best understood by reference to the drawings. The terms "left" and "right" as used herein are based on the perspective of the athlete approaching the hurdle. Reference characters ending in "L" refer to the left side and reference characters ending in "R" refer to the right side. Unless noted otherwise, the left side and right side components are identical or mirror images. Accordingly, a description of a component from one side is also a description of the corresponding component from the other side. The terms "leading," "trailing," "forward," and "rearward" are also based on the perspective of the athlete approaching the hurdle. A preferred embodiment of the hurdle 10 of this invention has two legs, a left leg 15L and a right leg 15R, and a cross support 20. Two stationary uprights, a left upright 25L and a right upright 25R, extend upwardly from the trailing ends of the legs. The legs, cross support, and the upright are generally an integral unit and are often collectively referred to as the base assembly. Two movable telescoping gate tubes, left gate tube 30L and right gate tube 30R, fit over the uprights. A gate board 35 connects the top ends of the gate tubes. The gate tubes and the gate board are often collectively referred to as the riser assembly. An internal counterweight system 40 automatically moves a counterweight in each leg to maintain the tip-over weight relatively constant as the height of the gate board is varied. A height adjustment system 60 enables the position of the riser assembly relative to the uprights to be varied. The components are discussed in detail below.

2. Legs and Cross Support

The hurdle contains two horizontal legs, left leg 15L and right leg 15R, having a length that is typically set by a track and field governing body. The legs are hollow to accommodate the counterweight system. The legs are substantially parallel so they do not intrude upon the lane in which the hurdle is located or upon the adjacent lanes. The left leg has a leading end 16L and a trailing end 17L. The right leg has a leading end 16R and a trailing end 17R. The trailing ends of the legs are joined by a cross support 20 to provide more structural strength and to house parts of the height adjustment system. The legs and cross support are preferably made of rectangular aluminum tubing with a width of about two to three inches.

3. Uprights

Stationary hollow uprights, left upright 25L and right upright 25R, extend upwardly from the trailing ends of the legs. In the preferred embodiment, the uprights are made of rectangular aluminum tubing with a width of about two to three inches. Caps preferably fit into the tops of the uprights. As explained in detail below, the caps in the preferred embodiment form parts of the counterweight and the height adjustment systems. As previously mentioned, the uprights, legs, and cross support are commonly known collectively as the base assembly.

4. Gate Tubes

Telescoping gate tubes, left gate tube 30L and right gate tube 30R, fit over the uprights. In the preferred embodiment, the gate tubes are rectangular aluminum tubes that fit over (overlap) the uprights. The inside dimensions of the telescoping tubes are preferably slightly greater than the outside dimensions of the uprights so the telescoping gate tubes can move freely up and down. In the preferred embodiment, left gate tube cap 31L fits onto the top of the left gate tube and right gate tube cap 31R fit onto the top of the right gate tube. The gate tube caps contain recesses for the attachment of the gate board and for connection of components of the height adjustment system.

5. Gate Board

A gate board 35 connects the tops of the gate tubes. In the preferred embodiment, the gate board is attached to the caps on the gate tubes. The gate board has a height of about two to four inches and is generally made of a durable lightweight material such as LEXAN polycarbonate, polyvinyl chloride (PVC), wood, or the like. As previously mentioned, the assembly of the gate board and the telescoping gate tubes is commonly known as the riser assembly. To adjust the height of the hurdle, the riser assembly is moved relative to the base assembly (the legs, cross support, and the uprights).

6. Counterweight System

Figure 2:
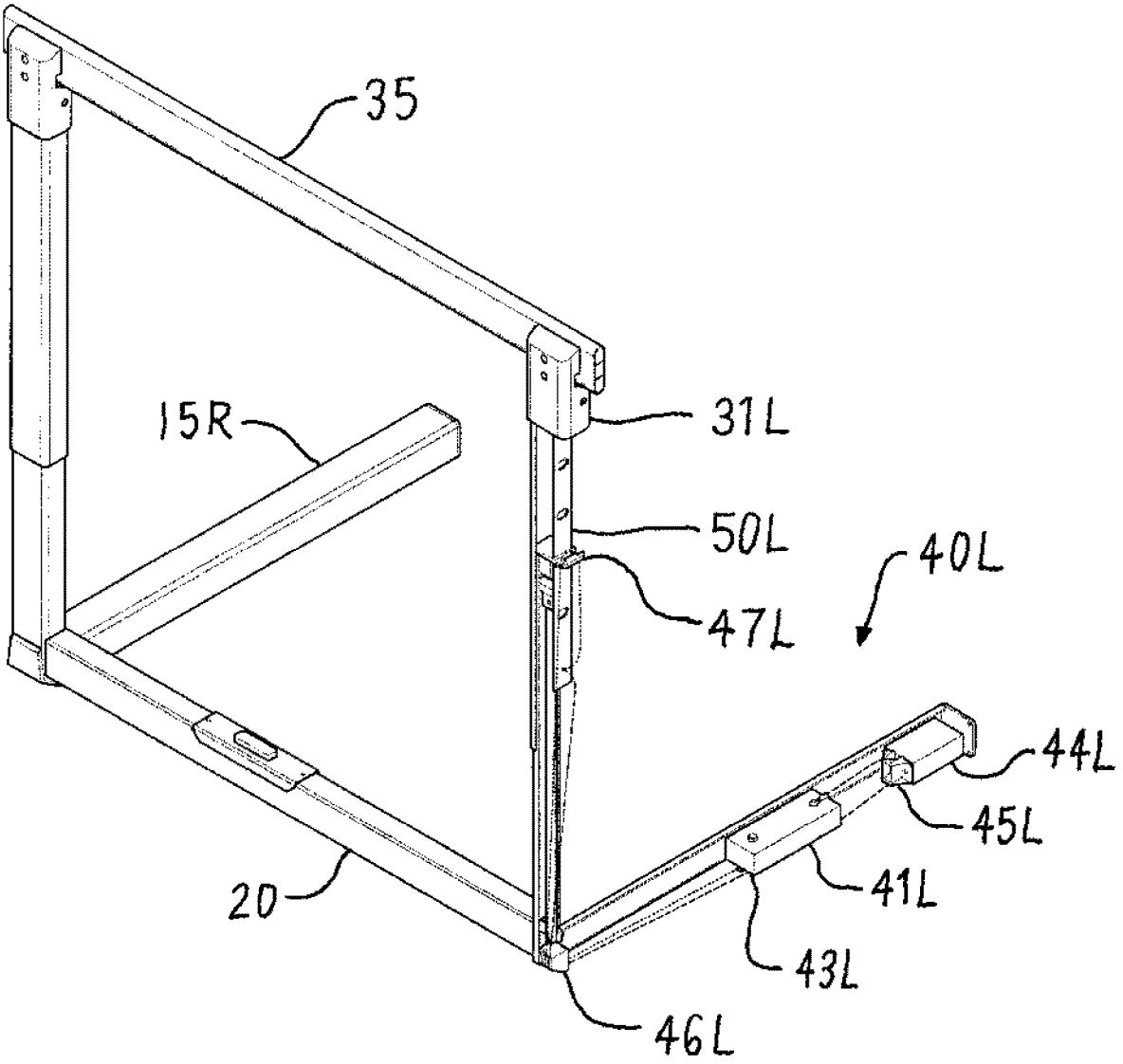
FIG. 2 is a rear and left side cutaway perspective view thereof with the left side counterweight system shown.
Figure 3:
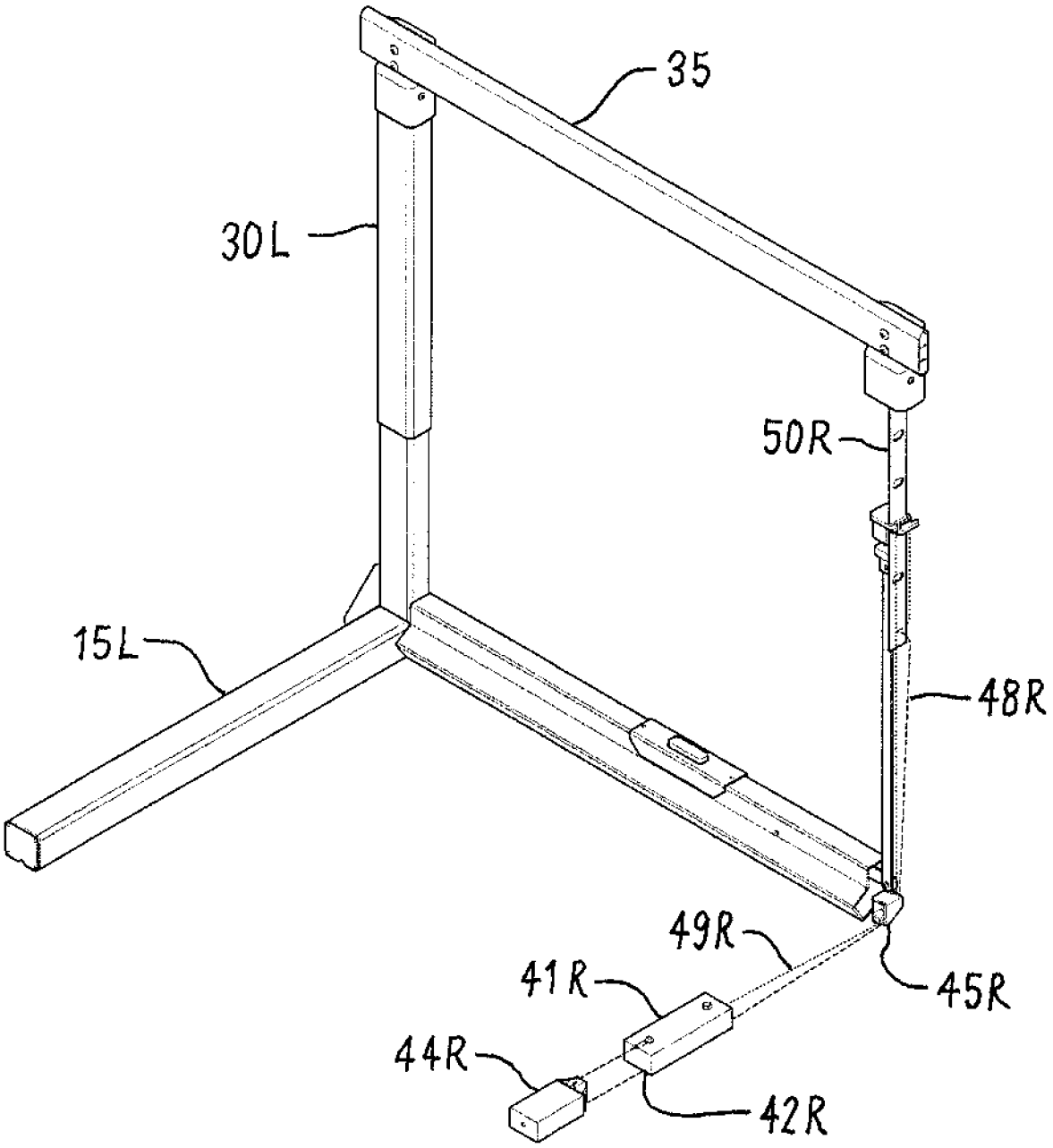
FIG. 3 is a front and right side cutaway perspective view thereof with the right side counterweight system shown.

The hurdle has a counterweight system to maintain a relatively constant tip-over weight regardless of the height of the hurdle. Manually adjustable counterweights are suitable. However, automatic systems are preferred in which the counterweights are connected mechanically to the riser assembly so that they move automatically as the riser assembly is moved. The most preferred counterweight system 40 is shown in FIGS. 2 and 3 with a leg, an upright, and a gate tube omitted (cut away) to show the interior. For purposes of illustration, the left side system 40L is shown in FIG. 2 and the right side system is shown in FIG. 3. The system is substantially the same on each side of the hurdle so only one side is usually described and is sometimes the left side and sometimes the right side. The counterweight system includes a movable counterweight, a stationary counterweight, cable guides, a height adjustment bar, and cables. A similar counterweight system is described in detail in Carrel et al., U.S. Pat. No. 9,486,714, Nov. 8, 2016, previously incorporated by reference.

The left movable counterweight 41L has a leading end and a trailing end 43L. The right movable counterweight 41R has a leading end 42R and a trailing end. The shape of the counterweight generally conforms to the shape of the leg. In the preferred embodiment, the leg and the counterweight both have rectangular cross-sections. The size of the counterweight is preferably slightly less than the internal size of the leg so that it does not bind and it is large enough that it cannot turn or rotate or otherwise change orientation.

The weight of the counterweight is a matter of choice that depends on the weight and dimensions of the hurdle. The counterweight is preferably made of a dense material such as steel or the like. The counterweight moves back and forth inside the leg so friction between the bottom of the counterweight and interior of the leg is preferably minimized. The counterweight is positioned midway along the leg when the hurdle is at a middle height so that the counterweight can move in both directions (toward the leading end when the height of the hurdle increases and toward the trailing end when the height of the hurdle decreases). In addition to a movable counterweight, a permanently mounted, stationary counterweight 44L in the leading end of each leg is often desirable to achieve the desired tip-over weight.

The internal counterweight system contains three cable guides on each side. The first guide 45L is positioned on the trailing end of the stationary counterweight. The second guide 46L is positioned at the intersection of the leg and the upright. The third guide 47L is positioned at the top of the upright cap. The upright cap is described in more detail below in reference to the height adjustment system.

The internal counterweight system includes height adjustment bars 50L and 50R inside the gate tube and upright on each side. The height adjustment bar contains a plurality of vertically spaced apart bores that correspond with the different heights of the hurdle. The top of the height adjustment bar is connected to the gate tube cap, the middle of the bar passes through a slot in the upright cap, and the bottom of the bar extends downwardly into the upright. As explained in detail below, the height adjustment bar provides an attachment point for the cables. The height adjustment bar provides the mechanism for applying a pulling force to one of the cables when the gate board is raised and to the other cable when the gate board is lowered. It will be seen that the height adjustment bar performs two functions in the preferred embodiment. It forms the connecting point for the cables of the counterweight system and it forms part of the height adjustment system.

The internal counterweight system contains a first cable 48R and a second cable 49R that are shown in broken lines. The first end of the first cable is connected to the bottom of the height adjustment bar. The cable then runs vertically and downwardly to the second guide, then forwardly and horizontally to the first guide on the stationary counterweight, and then rearwardly and horizontally to the leading end of the movable counterweight where the second end is connected.

The first end of the second cable is connected to the bottom of the height adjustment bar. The cable then runs vertically and upwardly to the third guide, then vertically and downwardly to the second guide, and then forwardly and horizontally to the trailing end of the movable counterweight where the second end is connected. The two cables, the height adjustment bar, and the movable counterweight thus form a loop. As the height adjustment bar moves up, the counterweight moves forwardly. As the height adjustment bar moves down, the counterweight moves rearwardly.

The cables are sufficiently taut that they are retained on the cable guides and drag little against the interior of the legs and uprights. If desired, one or more of the cable guides includes a mechanism for adjusting cable tension.

7. Height Adjustment System

The height adjustment system 60 is used to adjust the height of the gate board. The height is determined by the position of the riser assembly relative to the base assembly. The height adjustment system of the preferred embodiment has an actuator comprising a pedal 61 with a plunger 62 in the cross support. Depressing the pedal with a foot actuates a mechanical linkage that retracts spring loaded posts that hold the height adjustment bars (and the rest of the riser assembly) in place. The pedal is preferably positioned off center in the cross support so it is directly in front of a foot of a person standing between the legs and adjusting the height of the hurdle.

Figure 4:
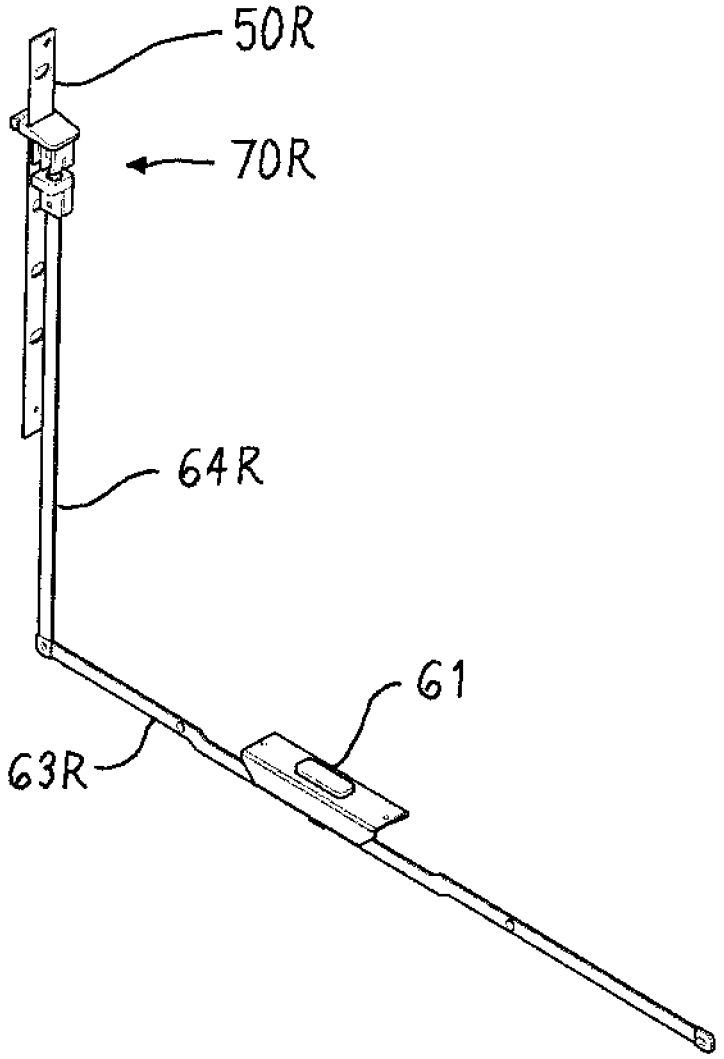
FIG. 4 is a rear and left side perspective view of the right side of the height adjustment system.
Figure 5:
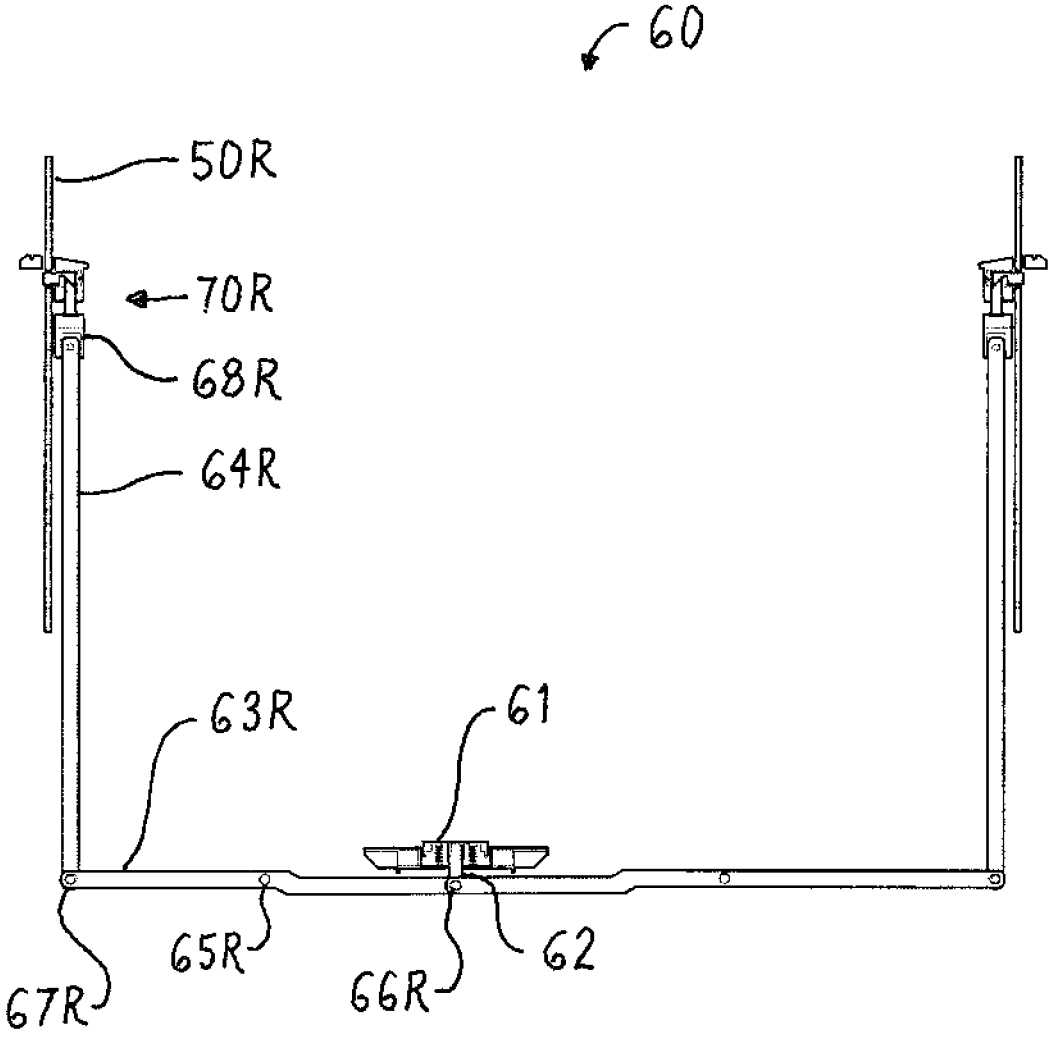
FIG. 5 is a rear elevation view of the height adjustment system.

Referring to FIGS. 4 and 5, only the right side of the linkage of the preferred embodiment is described. The linkage includes a right side horizontal connecting rod 63R that pivots about fulcrum pivot 65R. The right side horizontal connecting rod is connected to the pedal plunger at its inner end 66R and is connected to a right side vertical connecting rod 64R at its outer end 67R. The top of the right side vertical connecting rod is connected to a right side block 68R. These connections allow the parts to pivot. The right side block contacts a right side post assembly 70R at the top of the right side upright.

Figure 6:
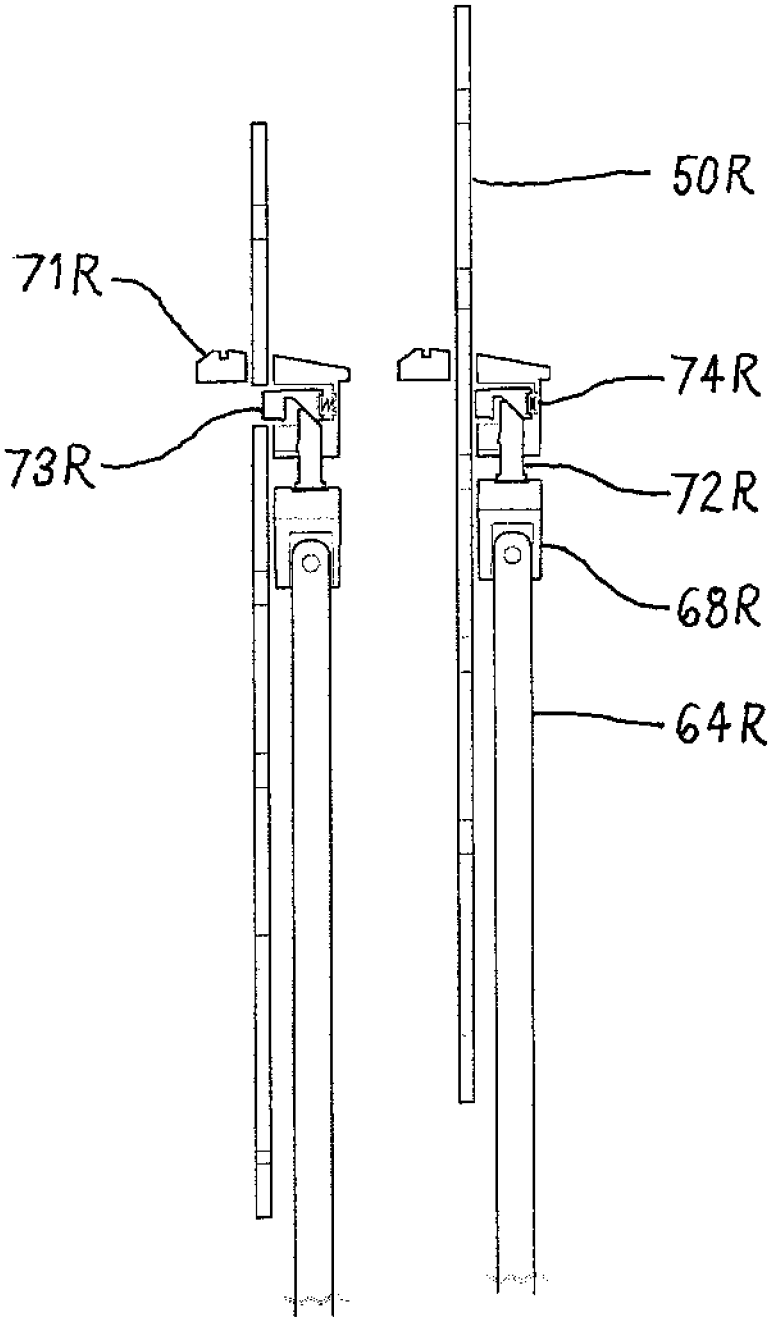
FIG. 6 is a detailed schematic diagram of the post assembly.

The post assembly is shown in detail in FIG. 6. In the left view, the post is in the engaged position extending into a bore in the height adjustment bar and fixing the riser assembly at the chosen height. In the right view, the post is in the retracted and disengaged position allowing the riser assembly to move upwardly or downwardly to the desired position. The post assembly includes an upright cap 71R, a projection 72R, a post 73R, and a coil spring 74R. The upright cap fits into the top of the upright and has a slot through which the height adjustment bar passes. The upright cap also has recesses for the projection, the post, and the coil spring. The lower surface of the projection is contacted by the block at the top of the vertical connecting rod. The projection contains a sloped upper surface forming an inclined plane. The sloped upper surface contacts the mating sloping surface on the underside of the post. The coiled spring biases the post in an outward position where it engages one of the bores in the height adjustment bar. It can be appreciated that depressing the pedal causes the plunger to depress the inner end of the horizontal connecting rod, which causes the outer end of the horizontal connecting rod to rise, which causes the vertical connecting rod and the block to rise, which causes the projection to move against the post, and which causes the post to retract and the coil spring to compress.

As previously discussed, the Watry et al. patent and the Bray et al. patent disclose height adjustment systems that are also suitable. A variety of other linkages between the pedal and the posts are also suitable.

8. Dimensions and Markings

The size of the hurdle is typically set by a track and field governing body. The hurdle generally has a width of either about forty-one inches or about forty-seven inches and the height of the hurdle (measured from the ground to the top of the gate board) is generally adjustable between about thirty and forty-two inches. The height of the hurdle is fixed by the position of the riser assembly relative to the base assembly. The hurdle preferably contains a plurality of set height adjustments. In the preferred embodiment, each upright has five adjustments for the following categories: (1) women's low; (2) women's high; (3) men's intermediate; (4) high school boy's high; and (5) men's high.

The uprights are generally marked to indicate the different hurdle heights. Other markings on the hurdle are matters of choice.

9. Operation and Advantages

The operation of the hurdle can now be considered. The user stands between the legs and holds the gate board in one or both hands. The user then steps on the pedal to disengage the spring loaded posts holding the riser assembly in position. The user then moves the riser assembly to the desired position and steps off the pedal. The spring loaded posts engage again and the user lets go of the gate board. As the riser assembly moves, the counterweight automatically moves back or forth within the leg to keep the tip-over weight relatively constant and within limits set by the relevant track and field governing body.

The height adjustment system enables both hands to be placed on the gate board at the most ergonomic positions rather than on the gate tubes. Furthermore, the system enables the gate board (and entire riser assembly) to be moved without having to simultaneously push buttons or pull triggers with the hands. The system enables persons to adjust the height without leaning over to reach the push buttons or pull triggers. The system also enables persons to adjust the height with only one hand.

We claim:

1. A hurdle comprising:

(a) a left horizontal hollow leg and a right horizontal hollow leg, each having a leading end and a trailing end;

(b) a horizontal hollow cross support connecting the trailing ends of the left horizontal hollow leg and the right horizontal hollow leg;

(c) a left stationary hollow upright and a right stationary hollow upright, the left stationary hollow upright extending upwardly from the trailing end of the left horizontal hollow leg and the right stationary hollow upright extending upwardly from the trailing end of the right horizontal hollow leg;

(d) a left movable hollow gate tube and a right movable hollow gate tube, each having a top end, the left movable hollow gate tube telescoping relative to the left stationary hollow upright and the right movable hollow gate tube telescoping relative to the right stationary hollow upright;

(e) a gate board connecting the top end of the left movable hollow gate tube and the top end of the right movable hollow gate tube;

(f) a counterweight system for maintaining tip-over weight, the counterweight system comprising:

(i) a left movable counterweight inside the left horizontal hollow leg and a right movable counterweight inside the right horizontal hollow leg;

(ii) a left height adjustment bar containing a plurality of vertically spaced bores and a right height adjustment bar containing a plurality of vertically spaced bores;

(iii) two left cables running between the left movable counterweight and the left height adjustment bar and two right cables running between the right movable counterweight and the right height adjustment bar; and (g) a height adjustment system for adjusting the gate board to a plurality of heights, the height adjustment system comprising:

(i) a pedal on the cross support;

(ii) a left horizontal connecting rod connected to the pedal, pivoting about a fulcrum point, and extending to the left stationary hollow upright, and a right horizontal connecting rod connected to the pedal, pivoting about a fulcrum point, and extending to the right stationary hollow upright;

(iii) a left vertical connecting rod connected to the left horizontal connecting rod, the left vertical connecting rod having an upper distal end, and a right vertical connecting rod connected to the right horizontal connecting rod, the right vertical connecting rod having an upper distal end;

(iv) a left projection connected to the upper distal end of the left vertical connecting rod and a right projection connected to the upper distal end of the right vertical connecting rod, each having a sloped upper surface; and (v) a left post having a sloped lower surface that engages the upper surface of the left projection, the left post being biased toward an outward position where it engages a bore in the left height adjustment bar, and a right post having a sloped lower surface that engages the upper surface of the right projection, the right post being biased toward an outward position where it engages a bore in the right height adjustment bar.

2. A hurdle comprising:

(a) a left leg and a right leg, each having a leading end and a trailing end, each being horizontal and hollow;

(b) a cross support connecting the trailing ends of the left leg and the right leg, the cross support being horizontal and hollow;

(c) a left upright and a right upright, each being stationary and hollow, the left upright extending upwardly from the trailing end of the left leg and the right upright extending upwardly from the trailing end of the right leg;

(d) a left gate tube and a right gate tube, each having a top end, each being movable and hollow, the left gate tube telescoping relative to the left upright and the right gate tube telescoping relative to the right upright;

(e) a gate board connecting the top end of the left gate tube and the top end of the right gate tube;

(f) a counterweight system for maintaining tip-over weight, the counterweight system comprising:

(i) a left counterweight inside the left leg and a right counterweight inside the right leg, each being movable;

(ii) a left height adjustment bar containing a plurality of vertically spaced bores and a right height adjustment bar containing a plurality of vertically spaced bores;

(iii) a left cable running between the left counterweight and the left height adjustment bar and a right cable running between the right counterweight and the right height adjustment bar; and (g) a height adjustment system for adjusting the gate board to a plurality of heights, the height adjustment system comprising:

(i) a pedal on the cross support;

(ii) a left horizontal rod connected to the pedal, the left horizontal rod pivoting about a fulcrum point and extending to the left upright and a right horizontal rod connected to the pedal, the right horizontal rod pivoting about a fulcrum point and extending to the right upright;

(iii) a left vertical connected to the left horizontal rod, the left vertical rod having an upper distal end, and a right vertical rod connected to the right horizontal connecting rod, the right vertical connecting rod having an upper distal end;

(iv) a left projection connected to the upper distal end of the left vertical rod and a right projection connected to the upper distal end of the right vertical connecting rod, each having a sloped upper surface; and (v) a left post having a sloped lower surface that engages the upper surface of the left projection, the left post being biased toward an outward position where it engages a bore in the left height adjustment bar, and a right post having a sloped lower surface that engages the upper surface of the right projection, the right post being biased toward an outward position where it engages a bore in the right height adjustment bar.

* * * * *